United States Patent [19]

Latimer et al.

[11] 4,178,704

[45] Dec. 18, 1979

[54] SUCTION NOZZLE DREDGE HEAD

[75] Inventors: John P. Latimer; Robert M. Donaldson; Ted W. Christian; Glen E. Miller, all of Newport News, Va.

[73] Assignee: Deepsea Ventures, Inc., Gloucester Point, Va.

[21] Appl. No.: 847,482

[22] Filed: Nov. 1, 1977

[51] Int. Cl.[2] ..... E02F 3/94

[52] U.S. Cl. ..... 37/57; 37/58; 37/DIG. 8

[58] Field of Search ..... 37/54, 55, 57, 58, DIG. 8; 299/8

[56] References Cited

U.S. PATENT DOCUMENTS

| | | | |
|---|---|---|---|
| B 531,753 | 3/1976 | Brockett | 37/57 |
| 597,190 | 1/1898 | Reynolds | 37/57 X |
| 1,097,722 | 5/1914 | Lake | 37/55 |
| 1,729,054 | 9/1929 | Shotwell | 37/58 |
| 2,204,584 | 6/1940 | Flower | 37/55 X |

*Primary Examiner*—Clifford D. Crowder

*Attorney, Agent, or Firm*—Barry G. Magidoff

[57] ABSTRACT

To mechanically assist the suction action of a dredge head in dislodging particles embedded, e.g., on the ocean floor, a plurality of fingers extend downwardly from along the upper edge of an obliquely downwardly and forwardly facing nozzle opening. The fingers are resiliently connected to the nozzle and thus are capable of being bent downwardly so as to be juxtaposed across and thus temporarily block, the nozzle opening, whereby the intake of oversized particles is prevented.

17 Claims, 6 Drawing Figures

SUCTION NOZZLE DREDGE HEAD

This invention relates to means for dislodging particles embedded in an ocean floor so as to improve the efficiency of pick-up of a suction nozzle-type dredge head, especially of the type useful for the recovery of ocean floor nodules ores, while avoiding clogging caused by over-size particles.

With the recognition of the limited supplies of raw materials, and especially metals, from previously available terrestrial mine sites, a great deal of effort has been put into the development of means to mine valuable metal ores from the abyssal depths of the oceans. Such means have generally centered about the utilization of extremely deep water dredging means, especially at depths of between 10,000 and 18,000 feet, to bring up what is known as ocean floor nodule ore, or manganese nodules.

The extreme conditions met at such great ocean depths, particularly in the way of pressures, have necessitated the development of a new generation of dredging equipment. Generally, a dredging means is connected to a surface vessel by way of a device for bringing the ore from the ocean floor to the surface. The dredging head can be, for example, of the suction nozzle variety, wherein the ore is literally sucked into a nozzle, much in the way of a vacuum cleaner, and then transferred to the vertical means rising to the surface. Such vertical means, generally utilized in combination with a suction head nozzle, include hydraulic means for lifting the ore suspended in, generally, water. Mechanical means for the removal of such ocean floor ores have also been utilized, including, for example, continuous bucket chains or digging scoops.

Generally, the dredging means, of whatever type, are pulled through the water utilizing, for example, the length of pipe for hydraulically lifting the ore from the ocean floor to the surface vessel. The dredging means, and particularly the suction nozzle head, is thus subject not only to the pressures at the abyssal depths but also to the problems created by the continuing flow of water as it is moved along the ocean floor, by towing, as well as problems of solid obstacles on the generally not well charted ocean floor.

Because of the inability of man to survive and work at these great depths, even by utilizing the newest experimental techniques, the operation of such dredges has necessarily entailed telemetric controls. Such long distance operation of a device has, of course, decreased the efficiency of collection of the operation; but such inefficiency has been, of necessity, accepted as part of the risks of any such venture. In an attempt to improve the recovery rate, for example, of the suction head nozzle-type devices, mechanical means have been employed, such as by way of fingers or probes, thrusting ahead of the nozzle opening to loosen the nodule particles from the ocean floor (see, e.g., U.S. Pat. Nos. 3,429,062 and 3,226,854). Although this has been at least partially successful, there have also been problems created by over-size particles jamming the nozzle and a certain amount of loss caused by smaller particles being swept along the side of the nozzle after being dislodged by the fingers.

Deposits of valuable metal ores are found lying on the surface of the soft sea floor as nodules, or as generally fist-sized or smaller "rocks", which are usually partially immersed within the sediment on the ocean floor. The nodule materials, of course, vary greatly in size, from what can be considered relatively small pebbles or even grains, up to relatively large rocks, or even boulders. Granite and other stone boulders are, of course, also often encountered when passing along the deep ocean floor.

It is accordingly an object of the present invention to provide means to improve the effectiveness of a suction nozzle dredge head in removing nodules and other ore of a like particulate nature from the ocean floor.

It is a further object of this invention to provide means to shield a dredge head from the intake of oversize particles which tend to clog the nozzle, requiring shut-down for cleaning.

In accordance with the present invention there is provided an improved suction nozzle assembly, adapted for gathering objects from the ocean floor, as in a dredge head assembly, the nozzle assembly comprising a nozzle having a nozzle opening adjacent a first end thereof, and a plurality of relatively slender, elongated projections, or fingers, resiliently connected to the edge of the nozzle opening, and movement-limiting means permitting pivotal movement of at least a portion of the fingers from a first extended position to a second pivoted position, wherein each finger is juxtaposed across the nozzle opening so as to interfere with the passage of material into and through the nozzle opening.

The fingers, which are pivotally connected at one end to the nozzle, preferably immediately adjacent the nozzle opening, can be connected so as to permit the entire projecting length to pivot as a unit, about a rigid pivot axis, or each finger can be at least partially formed of a flexible material, wherein the pivoting movement is obtained by a flexing of the finger, or projection. Both embodiments of the present invention, the flexible connection and the rigid pivot axis, include resilient means which bias the projection towards the first extended position from its pivoted position, juxtaposed across the nozzle opening. Thus, this invention comprises both the use of a resilient, flexible material of construction for each finger and the use of a resilient bias means, e.g., a spring or other elastic member, including pneumatic means, operatively connected to the pivoting projection. Further, the fingers pivotally connected about a rigid axis can be relatively rigid or flexible, if desired, for additional freedom of action.

Preferably, the nozzle opening has an elongated shape, for example, a rectangular or oval shape; the fingers should be connected to the nozzle adjacent a long side of the nozzle opening. The fingers are capable of pivoting across a short dimension of the nozzle opening, and preferably each finger extends substantially parallel to the short axis of the opening in the pivoted position.

Most preferably, the angle of rotation between the first fully extended position of the fingers and the second pivoted position juxtaposed across the nozzle opening is not greater than 90°.

In the preferred embodiment of the present invention, motion support means are provided operatively connected to the nozzle, preferably at a position adjacent the first end defining the nozzle opening, and adapted to support the nozzle during movement thereof, especially when being moved along the ocean floor. Such motion support means includes skid means, such as sled members, or rolling means, such as wheels, lugs, or rolling ball means. Such motion support means are preferably connected to the nozzle adjacent the edge opposite that to which the projecting fingers are connected so as not to interfere with the movement of the fingers. The plane defined by the motion support means can be parallel to the plane formed by the edges framing the nozzle opening. However, it has been found preferable to face the nozzle opening oblique to the motion support plane, such that the nozzle opening faces obliquely downwardly, and preferably, obliquely towards the fingers. Optimally, the angle between the fingers and the plane of the nozzle opening is in the range of from about 45° to about 60°. The angle between the plane of the nozzle opening and motion supporting surface is in the range of from about 30° to about 45°.

The projecting fingers preferably project beyond the motion supporting plane, in order to provide the desired digging effect during movement of the nozzle over, for example, the ocean floor.

The term "relatively rigid" as used herein in connection with the projections, or fingers, indicates that the fingers are not substantially flexed, or bent, under the stress which is normally impressed upon the fingers during operation of the dredge; i.e., at the stress which is sufficient to overcome the bias means acting to prevent pivoting movement about the rigid axis.

In a most preferred embodiment, the nozzle has an elongated shape, extending from the nozzle opening along a greater length than the width of the nozzle opening. The nozzle is generally adapted to be connected at a second end, preferably at the end of its long dimension, to the intake end of a suction pump.

Further, in accordance with the present invention, there is provided a dredge vehicle adapted for movement over the ocean floor in a forward direction, a suction nozzle assembly adapted for gathering objects from the ocean floor and operatively connected to and supported by the vehicle; the suction nozzle assembly comprising a nozzle having a nozzle inlet located adjacent a lower end of the nozzle, the nozzle opening defining a plane extending along one dimension from the forward to the rearward end of the dredge vehicle, and a plurality of projecting fingers pivotally, resiliently connected to the nozzle adjacent the forward edge of the nozzle opening and pivotal movement limiting means operatively connected between the projecting fingers and nozzle designed to limit the pivoting movement of the projecting fingers from a first downwardly extending position to a second folded position juxtaposed across the nozzle opening, and bias means for biasing the projecting fingers towards the first position. Motion supporting means are preferably connected to the nozzle so as to move along the supporting surface of the ocean floor, and support the nozzle a defined distance thereabove.

Optimally, each finger, in its first extended position, extends downwardly substantially perpendicularly to the supporting surface, i.e., to the forward direction, but preferably not deviating from the perpendicular by more than about 30°, and most preferably by not more than about 15° in a forward direction, i.e., away from the nozzle opening. The projecting fingers are thus able to dig into the ocean floor sediment layer and dislodge ore particles embedded therein to be gathered into the suction nozzle head, without becoming jammed into the ocean floor or against any obstruction on the ocean floor. Furthermore, if an excessively large object is dislodged, the fingers can pivot over the nozzle opening to prevent intake of such oversize particles. This type of pivoting finger has been found to be most effective for increasing the recovery efficiency of such dredge head nozzles with a minimum of undesirable stirring up of the ocean floor sediment.

A further understanding of the present invention can be obtained by reference to the preferred embodiments for achieving the desired objects and improvements set forth in the illustrations of the accompanying drawings. The illustrated embodiments, however, are merely exemplary of certain presently known preferred means for carrying out the present invention. The drawings are not intended to limit the scope of this invention, but merely to clarify and exemplify, without being exclusive thereof.

Referring to the drawings.

Figure 1:
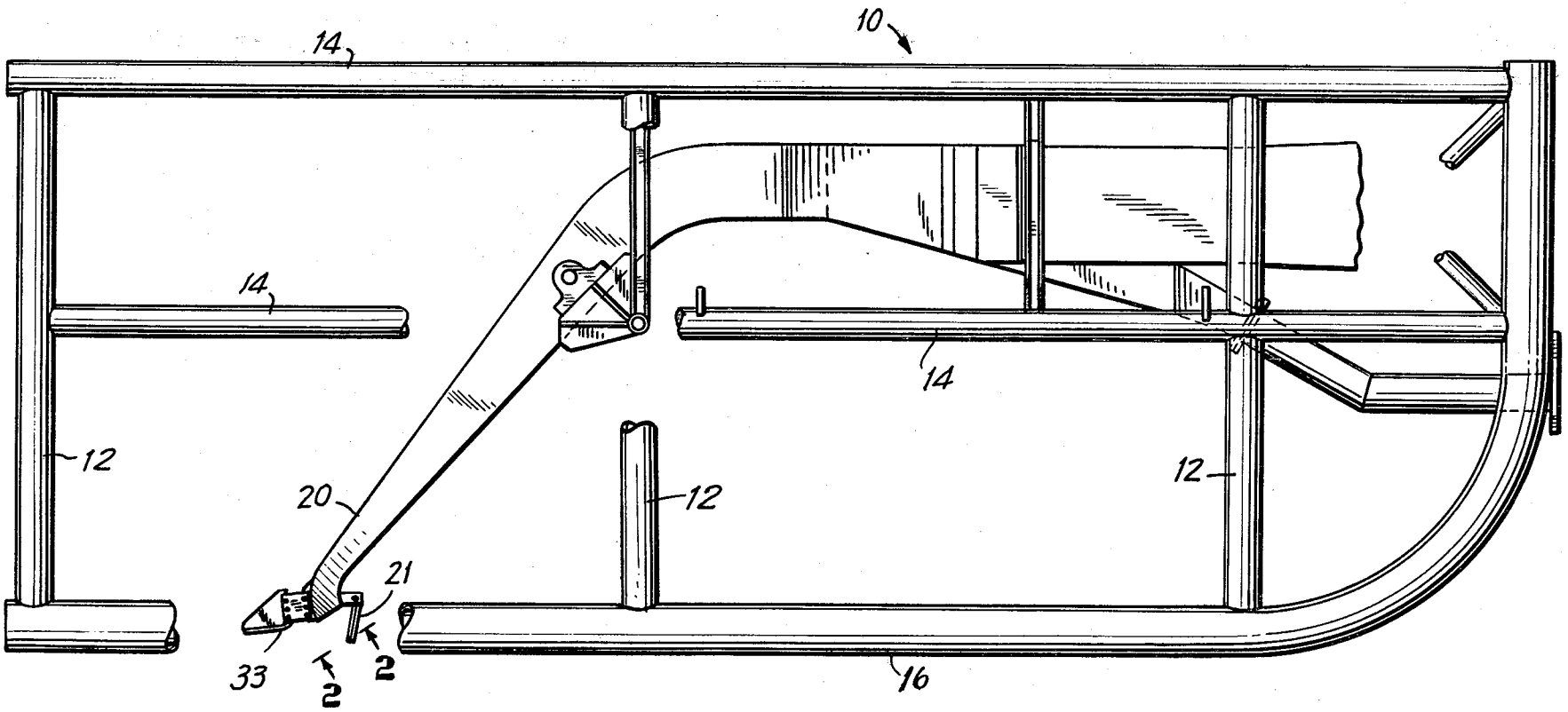
FIG. 1 is a partially broken away side elevation view of a dredge vehicle for supporting a dredge nozzle and projecting means in accordance with the present invention.

A dredge vehicle chassis, generally indicated by the numeral 10, is formed of a plurality of intersecting vertical tubular members 12 and horizontal tubular members 14. The vehicle is intended to ride along the lower horizontal skid means 16, along the ocean floor surface. A suction head nozzle 20 is supported by the chassis 10. The nozzle 20 is in turn connected to a water conduit, and then to a suction pump, not shown.

The embodiment of FIG. 1 comprises a nozzle opening, generally indicated by the letter "O", defined by the nozzle edges 13L, 13T and 15. A pivoting means, comprising a pin 17, rotatably connected to supporting frames 19, which are in turn rigidly connected to the nozzle adjacent the leading long edge 13L. A series of longitudinally projecting relatively rigid fingers 21, are supported by the pin 17, and project downwardly therefrom, to a position beyond the lower trailing edge 13T of the nozzle opening O. A torsion spring 23 is connected between the projecting finger 21 and the stationary support member 19, so as to bias the projection 21 towards the extended position, i.e., substantially vertical position, shown in FIG. 1. Further forward movement of the finger 21, i.e., in a direction away from the nozzle opening O, is positively prevented by the stop member 25.

Figures 2, 3, 4:
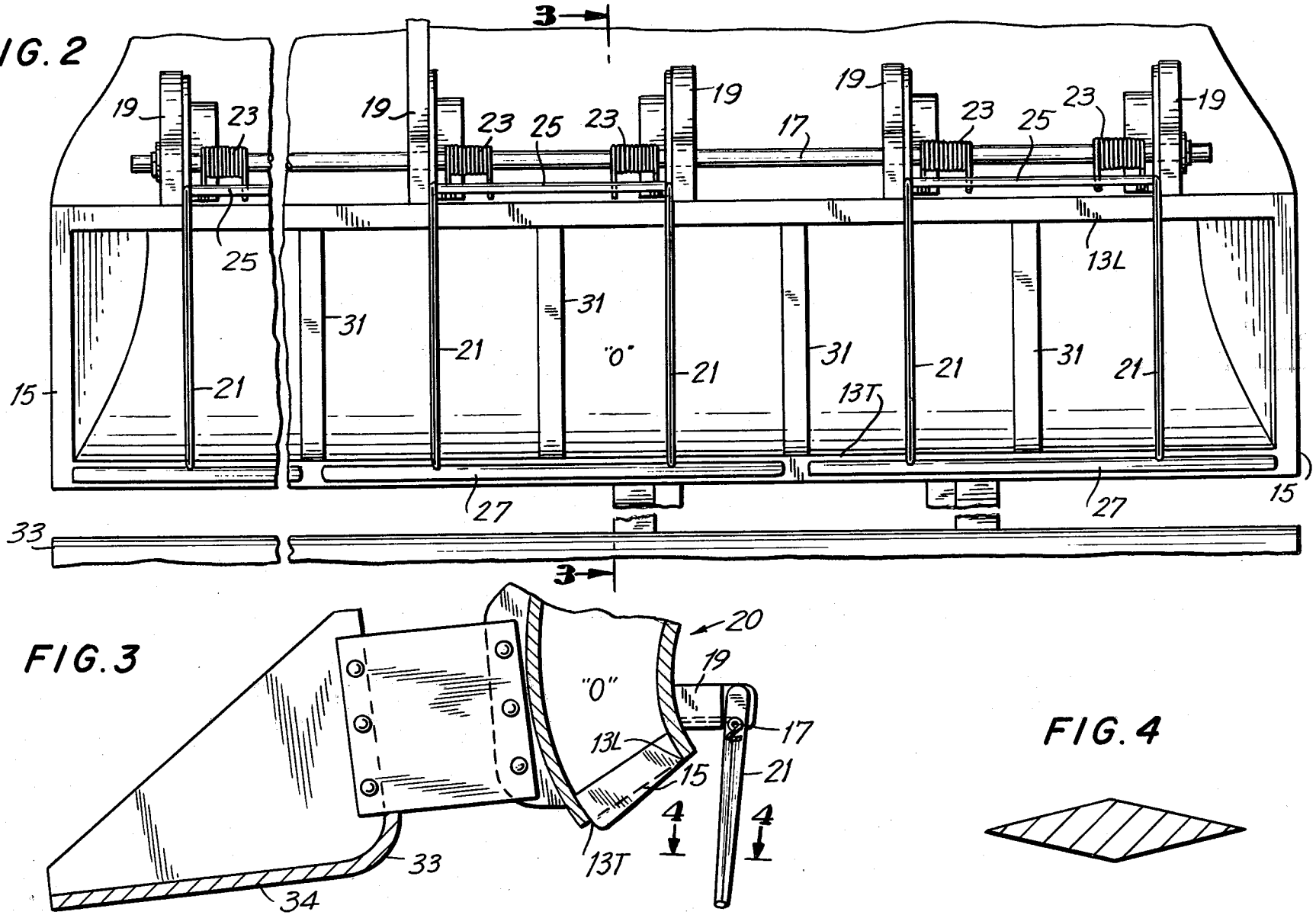
FIG. 2 is a view of the nozzle opening and projecting means taken along lines 2—2, of FIG. 1 and showing the fingers in the pivoted position.
FIG. 3 is a partial view taken along lines 3—3 of FIG. 2.
FIG. 4 is a cross-sectional view along lines 4—4 of FIG. 3.

Referring to FIG. 2, a plurality of the projecting fingers 21 are rotatably supported upon the pin 17. In this particular embodiment, the projecting fingers 21 are joined together so as to move in pairs, by the transverse members 27 rigidly connected to the outer end, i.e., the lower end, of each finger 21. As shown, the transverse members 27 extend beyond the two supporting fingers 21 such that the ends of the adjoining transverse members 27 are separated by a distance substantially less than the distance between the adjoining fingers 21.

As shown in FIG. 2, when the fingers are in the folded position, such that they extend across the nozzle opening O, in a direction parallel to the narrow, or small dimension, of the opening, i.e., parallel to the short sides 15, the transverse member 27 abuts against the lower, trailing longitudinal edge 13T of the nozzle opening 0, which thus forms an effective stop means to prevent further pivotal movement of the fingers 21 in that direction.

The nozzle opening O, depicted in the drawings attached hereto, is substantially defined by rectangular edges 13 and 15.

A plurality of rigid divider plates 31 extend across the nozzle opening O and are rigidly connected to the opposite longitudinal edges 13L, 13T. These divider plates 31 are substantially parallel to the short transverse edges 15 of the nozzle opening O. The divider plates 31 are located substantially equidistantly between the projecting fingers 21, such that when the fingers 21 are in the folded position shown in FIG. 2, the alternating fingers 21 and divider plates 31 serve to substantially block the intake of undesirably large particles into the nozzle opening O.

A support shoe 33, or skid, is rigidly connected to the nozzle 20, adjacent the trailing edge 13T, i.e., extending rearwardly from the surface of the nozzle 20 opposite that to which the projecting fingers 21 are attached. The shoe 33 comprises a substantially flat undersurface 34 extending slightly below the trailing edge 13T of the nozzle opening O, but not extending down as far as the ends of fingers 21 and the transverse members 27 connecting the ends of fingers 21.

In operation, the dredge vehicle 10, can be either towed, or independently propelled along the surface of the ocean floor. The nozzle 20 is preferably pivotally supported from the dredge vehicle chassis 10 and suspended above the level of the surface over which the sled runners 15 move. The support shoe 33 provides additional support to insure that the nozzle opening O is held slightly above the surface of the ocean floor. The fingers 21 extend into any sediment present on the ocean floor surface so as to strike against, and desirably dislodge, any small ore particles, especially manganese nodules, resting upon and submerged within the sedimentary level. Upon contacting any larger than usual nodule particles, or other firm surface rigidly held on the ocean floor, the fingers 21 pivot rearwardly, so as to cover the nozzle opening O, and prevent the intake of any such undesirably large particles. Simultaneously, the presence of the fingers 21 over the nozzle opening 0, act as a bumper guard to protect the possibly fragile nozzle opening frame edges 13L, 13T, 15, from damage caused by any such rigid, firmly held objects.

The angle formed by the plane of the nozzle opening O, i.e., defined by the edges 15, 13L, 13T, is such as to face the opening O in a generally obliquely forwardly and downwardly direction. Although the nozzle opening O can face at an angle of as much as about, preferably, 60° from the direct downward direction, i.e., forwardly or rearwardly, it is most preferred that the nozzle O face in a forwardly direction, so as to obtain the greatest intake efficiency in the intake of nodule ore particles.

Figures 5, 6:
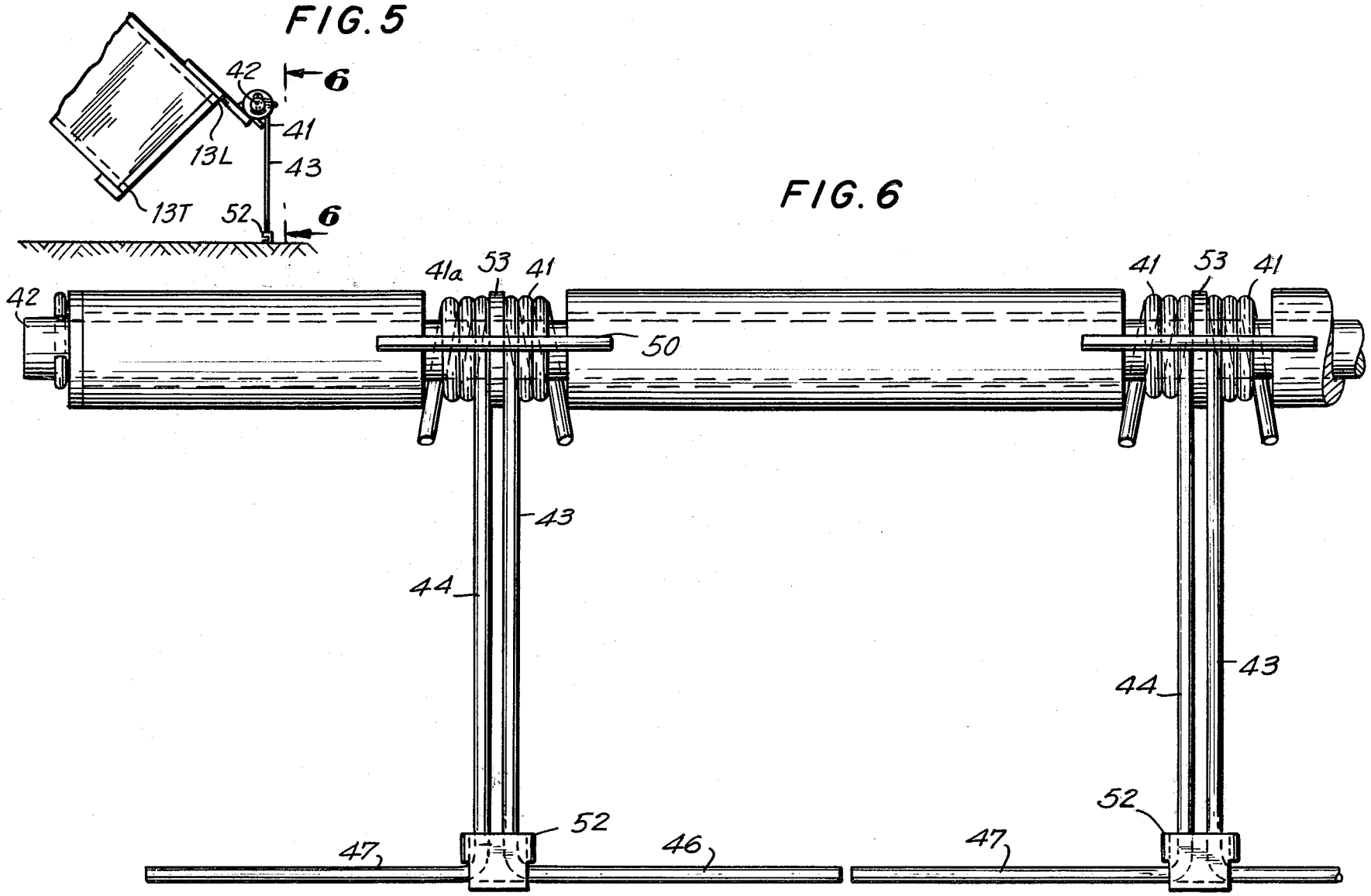
FIG. 5 is a detailed side elevation view of a flexible finger of the present invention.
FIG. 6 is a partial detailed view taken along lines 6—6 of FIG. 5.

Alternative projecting fingers are shown in FIGS. 5 and 6, formed of relatively flexible spring material.

The projecting fingers of FIGS. 5 and 6 are formed of flexible material and are flexibly connected to the upper leading edge of the nozzle opening O. In this embodiment, a length of flexible, resilient, spring wire is wrapped at one end, to form a coil spring 41, about a rigid rod 42. The rigid rod 42 is in turn rigidly connected to the leading edge 13L of a nozzle opening. A free end 43 extends out from the coiled portion, projecting downwardly therefrom and extending beyond the lower trailing edge 13T of the nezzle opening O. A substantially right angle bend is formed at the furtherest extended point of finger 43 and a transverse portion 46 extends parallel to the rod 42. An adjacent resilient projecting finger 44, also resiliently connected to the rigid rod 42 via coiled portion **41*a*, includes a transverse portion 47 extending in a direction opposite to that of the first transverse portion 46. A plurality of these flexible projecting fingers 43, 44 are provided attached to the pin rod 42 and extending along the longitudinal edge 13L of the nozzle opening O. Further, as shown in this embodiment, the members of each adjacent pair of the projecting fingers 43, 44, are connected by rigid connecting plates 52 at the adjoining right angle bends between the outer ends of the projecting fingers 43, 44 and the transverse portions 46, 47. To assist in maintaining the spacing of the projecting fingers, and to prevent the transverse bending of the projecting fingers 43, 44, spacer means 53 are provided between the coils 41, 41*a* on the projecting rod 42**.

The flexible projecting members 43, 44, when striking a relatively large or immovable object as the dredge vehicle moves, are capable of flexing rearwardly to a position lying across the nozzle opening "O", in much the same position as the pivoting rigid finger 21.

Generally, it has been found that the projecting fingers 21 or 43, 44, should be separated by a distance of from about 2½ to about 4 inches, and preferably from about 3 to about 3½ inches. Similarly, the projecting length of the fingers is preferably from about 5 to about 10 inches, and most preferably from about 6 to about 8 inches.

The dredge vehicle 10 can be any of a variety of devices, including the sled-type vehicle shown in the drawings, a wheeled vehicle, a tracked vehicle, or other means of supporting the dredge head means above, or on, the surface of the ocean floor. Any type of vehicle now known or developed in the future, including those which are self-powered or merely towed can be utilized.

The materials for use in constructing the projecting fingers in accordance with the present invention can be any material having the necessary structural strength, and/or resiliency and elasticity, as required to provide the desired activity as described above. For the present, stainless steel spring, for the resilient flexible fingers are preferred and a stainless steel rigid bar, is preferred for the rigid finger. However, other materials, including other metals, or polymeric plastic materials, having the desired combination of structural strength and resistance to corrosion can be utilized, whether now known or to be developed or discovered in the future.

The patentable embodiments of this invention which are claimed are as follows:

1. A suction nozzle assembly, adapted for gathering objects from the ocean floor, the nozzle assembly comprising a nozzle having nozzle edges framing a nozzle opening at a first end of the nozzle, a plurality of relatively slender, elongated fingers resiliently, pivotally connected adjacent a first edge of the nozzle opening, movement-limiting means permitting pivotal movement of at least a portion of the fingers from a first, extended position to a second pivoted position, wherein the fingers are juxtaposed across the nozzle opening so as to interfere with the passage of material into the nozzle opening, the elongated fingers being biased towards the first position, the fingers in the first position extending beyond a second, opposite edge of the first end of the nozzle.

2. The nozzle assembly of claim 1 wherein each finger is a relatively rigid projecting member, pivotally connected to the nozzle.

3. The nozzle assembly of claim 2 comprising, in addition, bias means comprising an elastic spring juxtaposed between the finger and the nozzle.

4. The nozzle assembly of claim 1 wherein each finger comprises a flexible, resilient member, resiliently connected to the nozzle.

5. A dredging vehicle adapted for movement over the ocean floor, having a forward end and a rear end, a suction nozzle assembly adapted for gathering objects from the ocean floor and operatively connected to and supported by the vehicle, the suction nozzle assembly comprising:

a nozzle;

nozzle edges defining a nozzle opening and located adjacent a first, lower end of the nozzle, the nozzle edges defining a plane extending along one dimension from the forward towards the rearward end of the dredge vehicle and along a second dimension transverse thereto;

a plurality of projecting fingers, pivotally and resiliently connected to the nozzle adjacent the forward edge of the nozzle opening;

movement-limiting means operatively connected to the nozzle and designed to limit the pivoting movement of the projecting fingers from a first downwardly extending position to a second folded position juxtaposed across the nozzle opening so as to interfere with the passage of material into the nozzle opening; and the projecting fingers being biased towards the first position.

6. The dredge vehicle of claim 5 wherein the nozzle opening faces obliquely forwardly and downwardly.

7. The dredge vehicle of claim 5 wherein the projecting finger extends downwardly at an angle of at least about 90° from the forward direction.

8. The dredge vehicle of claim 5 wherein each projecting finger comprises a flexible, resilient member, resiliently connected to the nozzle.

9. The dredge vehicle of claim 5 wherein each projecting finger is a relatively rigid projecting member, pivotally connected to the nozzle.

10. The dredge vehicle of claim 9 comprising, in addition, bias means comprising an elastic spring juxtaposed between each finger and the nozzle.

11. A suction nozzle assembly, adapted for gathering objects from the ocean floor, the nozzle assembly comprising a nozzle having nozzle edges framing a nozzle opening at a first lower end of the nozzle, a plurality of relatively slender, elongated fingers resiliently, pivotally connected adjacent an edge of the nozzle opening and a transverse finger member rigidly connected to the outer ends of adjacent fingers, movement-limiting means permitting pivotal movement of at least a portion of the fingers from a first, extended position to a second pivoted position, wherein the fingers are juxtaposed across the nozzle opening so as to interfere with the passage of material into the nozzle opening, the elongated fingers being biased towards the first position, the fingers in the first position extending below the first end of the nozzle.

12. The nozzle assembly of claim 11 wherein the angle between the nozzle opening plane and each finger in its first position is in the range of from about 45° to about 60°.

13. A dredging vehicle adapted for movement over the ocean floor, having a forward end and a rear end, a suction nozzle assembly adapted for gathering objects from the ocean floor and operatively connected to and supported by the vehicle, the suction nozzle assembly comprising:

a nozzle;

nozzle edges defining a nozzle opening and located adjacent a first, lower end of the nozzle, the nozzle edges defining a plane extending along one dimension from the forward towards the rearward end of the dredge vehicle and along a second dimension transverse thereto, the nozzle opening facing obliquely forwardly and downwardly;

a plurality of projecting fingers, pivotally and resiliently connected to the nozzle adjacent the forward edge of the nozzle opening;

movement-limiting means operatively connected to the nozzle and designed to limit the pivoting movement of the projecting fingers from a first downwardly extending position to a second folded position juxtaposed across the nozzle opening so as to interfere with passage of material into the nozzle opening; and the projecting fingers being biased towards the first position.

14. A suction nozzle assembly, adapted for gathering objects from the ocean floor, the nozzle assembly comprising a nozzle, nozzle edges, at a first end of the nozzle, defining an elongated nozzle opening having a relatively long axis and a relatively short axis, a plurality of relatively slender, elongated fingers resiliently, pivotally connected adjacent a first edge extending parallel to the long axis of the nozzle opening, movement-limiting means permitting pivotal movement of at least a porition of the fingers from a first, extended position to a second pivoted position, wherein the fingers are juxtaposed across the nozzle opening substantially parallel to the short axis so as to interfere with the passage of material into the nozzle opening, the elongated fingers being biased towards the first position, the fingers in the first position extending beyond a second, opposite edge of the first end of the nozzle.

15. The nozzle assembly of claim 14, wherein the nozzle opening is substantially a rectangle.

16. A suction nozzle assembly, adapted for gathering objects from the ocean floor, the nozzle assembly comprising a nozzle, nozzle edges framing a nozzle opening at a first lower end of the nozzle, a plurality of relatively slender, elongated fingers resiliently, pivotally connected adjacent an edge of the nozzle opening, motion support means operatively connected to the nozzle, adjacent the first end, the support means comprising a support surface, defining a plane situated intermediate between the first end of the nozzle and the outer end of the fingers, movement-limiting means permitting pivotal movement of at least a portion of the fingers from a first, extended position to a second pivoted position, wherein the fingers are juxtaposed across the nozzle opening so as to interfere with the passage of material into the nozzle opening, the elongated fingers being biased towards the first position, the fingers in the first position extending below the first end of the nozzle.

17. The nozzle assembly of claim 16, wherein the angle between the motion support plane and the nozzle opening is in the range of from about 30° to about 45°.

* * * * *